United States Patent [19]

Suzuki et al.

[11] Patent Number: 4,760,217

[45] Date of Patent: Jul. 26, 1988

[54] KEYBOARD HAVING LOWER CASING WITH INTEGRAL UPRAISED PORTION FOR SUPPORTING PC BOARD, AND KEY SWITCH HAVING AIR VENT IN PC BOARD

[75] Inventors: Makoto Suzuki, Nagoya; Mitsumasa Kako, Tokai; Satoshi Fukao, Kasugai, all of Japan

[73] Assignee: Brother Kogyo Kabushiki Kaisha, Aichi, Japan

[21] Appl. No.: 10,536

[22] Filed: Feb. 3, 1987

[51] Int. Cl.[4] ..... H01H 9/00; H01H 13/70

[52] U.S. Cl. ..... 200/5 A; 200/159 B; 200/306; 235/145 R; 400/488

[58] Field of Search ..... 200/5 R, 5 A, 159 B, 200/306, 293; 361/288, 398; 235/145 R; 400/479, 485–490

[56] References Cited

U.S. PATENT DOCUMENTS

| | | | |
|---|---|---|---|
| Re. 30,435 | 11/1980 | Fukao | 200/159 R |
| Re. 31,332 | 8/1983 | Larson | 200/5 A |
| 3,311,210 | 3/1967 | Peroni | 400/479 |
| 3,898,421 | 8/1975 | Suzumura | 200/306 X |
| 4,046,975 | 9/1977 | Seeger, Jr. | 200/306 X |
| 4,271,333 | 6/1981 | Adams et al. | 379/368 |
| 4,294,555 | 10/1981 | Galaske et al. | 400/488 |
| 4,331,852 | 5/1982 | Baran et al. | 210/306 |
| 4,363,942 | 12/1982 | Deeg et al. | 200/5 A |
| 4,423,464 | 12/1983 | Tamura et al. | 361/288 |
| 4,440,515 | 4/1984 | Nassimbene | 400/479 |
| 4,467,150 | 8/1984 | Leitermann et al. | 200/5 A |
| 4,485,279 | 11/1984 | Nakamura | 200/5 A |
| 4,528,428 | 7/1985 | Gotoh et al. | 200/5 A |
| 4,560,844 | 12/1985 | Takamura et al. | 200/5 A |
| 4,560,845 | 12/1985 | Takamura et al. | 200/5 A |
| 4,605,828 | 8/1986 | Gostomski, Jr. et al. | 200/5 A |

OTHER PUBLICATIONS

A. L. Akers et al., "Electronic Keyboard", IBM Technical Disclosure Bulletin, vol. 25, No. 11B, Apr. 1983, pp. 6219–6220.

*Primary Examiner*—J. R. Scott

*Attorney, Agent, or Firm*—Parkhurst & Oliff

[57] ABSTRACT

A keyboard including an upper casing which has a key-holder member for movably supporting keys with a movable electrode, and a lower casing which has an integrally formed upraised portion which defines a recess open in the bottom wall of the lower casing. A printed-circuit board is held in direct contact with the top wall of the upraised portion of the lower casing such that stationary electrodes on the printed-circuit board are opposite to the corresponding movable electrodes. The printed-circuit board may be a flexible film-like member on which an elastic sheet having elastically collapsible cap portions is disposed such that the cap portions cooperate with the film-like printed-circuit board to form enclosures in which the corresponding movable and stationary electrodes are accommodated, and such that the cap portions collapse upon operation of the keys for moving of the movable electrodes toward the stationary electrodes. The film-like board has an air vent communicating with each enclosure, while the top wall of the upraised portion of the lower casing has a groove communicating with the air vent, so that the air in the enclosure may flow into the groove through the air vent upon collapse of the cap portion.

15 Claims, 2 Drawing Sheets

KEYBOARD HAVING LOWER CASING WITH INTEGRAL UPRAISED PORTION FOR SUPPORTING PC BOARD, AND KEY SWITCH HAVING AIR VENT IN PC BOARD

FIELD OF THE INVENTION

The present invention relates to improvements in a keyboard used as a data input device for a typewriter and other instruments, and to improvements in key switches incorporated in such a keyboard.

In a known keyboard, a printed-circuit board having circuit patterns including stationary electrodes is retained in place by a downwardly curved, rigid retainer plate which rests on a suitable support structure provided on a lower casing of the keyboard. An example of this type of keyboard is shown in U.S. Pat. Nos. 4,560,844 and 4,560,845 owned by the assignee of the present application, and another entity. In the keyboard disclosed in these Patents, the support structure consists of a plurality of spaced-apart support walls which are either integral with the lower casing of the keyboard, or separate from but fixed to the lower casing. In the former case, the retainer plate resting on the support walls is fastened to the upper casing. In the latter case, the retainer plate is fastened to the support walls.

In the keyboard of the type indicated above, the use of the retainer plate results in an increase in the overall thickness of the keyboard. In particular, where the jumper wires connecting adjacent circuit patterns pass through slots formed in the retainer plate, a space must be provided between the retainer plate and the bottom of the lower casing. Therefore, the retainer plate cannot be supported directly on the bottom wall of the lower casing. This leads to a relatively large height of the operating face of the key switches from the bottom of the keyboard.

In assembling the keyboard, the retainer plate must be fastened to the upper casing or to the support walls. If the support walls are members separate from the lower casing, the support walls must be fixed to the lower casing. This procedure is time-consuming.

Usually, a movable electrode is secured to the underside of a top wall of each of multiple elastically collapsible cap portions formed on an elastic sheet which rests on the printed-circuit board, such that each cap portion cooperates with the corresponding area of the printed circuit board to define an enclosure in which the movable electrode and the stationary electrodes are accommodated. Normally, the movable electrode secured to the top wall of the cap portion is spaced apart from the stationary electrodes on the printed-circuit board. Multiple keys are supported movably in their axial direction between non-operated and operated positions. When each key is depressed to its operated position, the corresponding cap portion is pressed by the key, and elastically collapses, whereby the movable electrode is moved toward the stationary electrodes. Thus, a key switch consisting of the key and the movable and stationary electrodes is closed, producing an output corresponding to the operated key.

For easy collapse of the cap portions of the elastic sheet upon depression of the keys, it is a conventional practice to provide the enclosures formed by the cap portions and the printed-circuit board with air vents for allowing the air in the enclosures to escape when the cap portions collapse. Such air vents are formed in the base of the elastic sheet more precisely, air vent grooves are formed in the lower surface of the elastic sheet contacting the printed-circuit board, such that the grooves communicate with the enclosures.

However, it has been found difficult for such air vent grooves to serve in a satisfactory manner. Namely, the grooves cannot be given a sufficient cross sectional area. To give the grooves a sufficient depth, the base of the elastic sheet must have a large thickness. This not only increases the cost of the elastic sheet, but also leads to a decrease in the operating stroke of the key unless the height of the cap portions is increased. If the height of the cap portions is increased, the overall thickness of the keyboard is increased. While the cross sectional area of the air vent grooves may be increased by increasing the width of the grooves, this is not practical either. That is, such relatively wide grooves may be partially closed due to elastic deformation of the base of the elastic sheet by a force with which the elastic sheet is held against the printed-circuit board, or by a force exerted on the base of the elastic sheet when the cap portions are depressed by the keys. Thus, the air vent grooves have a relatively small effective cross sectional area, making it difficult to accomplish a high rate of escape flow of the air through the air vents from the enclosures.

Further, the conventional air vents cannot function at the end of an operating stroke of the key, or at the end of a collapse of the cap portion. As indicated at P in FIG. 3, the peripheral part of the cap portion contacts the upper surface of the printed-circuit board a short time before the cap portion has completely collapsed. In this condition, the peripheral part contacting the printed-circuit board blocks an air flow from the central portion of the enclosure into the air vent grooves.

SUMMARY OF THE INVENTION

It is therefore an object of the present invention to provide a keyboard which is simple in construction and easy to assemble, and which has a comparatively small overall thickness.

It is another object of the present invention to provide a keyboard which has simple and effective air breather means for allowing air to escape from enclosures defined by collapsible cap portions of an elastic sheet and the corresponding areas of a printed-circuit board, during collapse of the cap portions upon depression of keys of key switches.

A further object of the present invention is the provision of a keyboard which has such air breather means but has a relatively small thickness.

Yet another object of the invention is the provision of a key switch which has simple and effective air breather means which assures an easy and smooth operation of the key, and a fast response of the switch to the operation of the key.

According to the present invention, there is provided a keyboard comprising: an upper casing and a lower casing, which engage each other to form a keyboard frame; a printed-circuit board disposed within the frame, and having multiple pairs of stationary electrodes; a support plate fixed to the lower casing, and disposed below the printed-circuit board for supporting the printed-circuit board; a multiplicity of movable electrodes corresponding to the multiple pairs of stationary electrodes, each disposed movably toward and away from the corresponding pair of stationary electrodes; a multiplicity of operator-controlled keys corresponding to the multiplicity of movable electrodes, for moving the corresponding movable electrodes; and a key-holder member fixed to the upper casing, for supporting the multiplicity of keys such that the keys are slidably movable in its axial direction. The lower casing includes an integral bottom wall having an integrally formed upraised portion which defines a recess open in a central part of the bottom wall. The upraised portion has a top wall which forms a bottom of the recess. This top wall of the upraised portion constitutes the support plate for supporting the printed-circuit board.

In the keyboard of the present invention constructed as described above, a conventionally used rigid retainer plate is not used for supporting the printed-circuit board. The elimination of the retainer plate provides a reduction in the overall thickness of the keyboard, simplifies the construction, and permits easier assembling.

According to one feature of the invention, the top wall of the upraised portion of the lower casing has a slight downward curvature in a plane parallel to a transverse direction of the keyboard and perpendicular to the upraised portion.

According to another feature of the invention, the top wall of the upraised portion of the lower casing is inclined in a plane parallel to a transverse direction of the keyboard such that a height of an upper surface of the top wall from the bottom wall increases in a direction from a front toward a rear of the keyboard.

The lower casing having the upraised portion may be formed of a synthetic resin. Similarly, the upper casing and the key-holder member may consist of a one-piece structure formed of a synthetic resin.

According to a further feature of the invention, the multiplicity of operator-controlled keys have the same size and shape, and the support plate formed by the top wall of the upraised portion of the lower casing is downwardly curved in a plane perpendicular to a longitudinal direction of the keyboard. The key-holder member includes a downwardly curved base portion which has substantially the same curvature as the support plate. The key-holder member supports the keys in at least three parallel straight rows which extend in the longitudinal direction, such that a surface generally defined by top faces of the keys is downwardly curved.

According to a further feature of the invention, the printed-circuit board comprises a film substrate, and circuit patterns which include the stationary electrodes and which are disposed on an upper surface of the film substrate. The printed-circuit board rests on the support plate such that a lower surface of the film substrate is in direct contact with an upper surface of the support plate, that is the top wall of the upraised portion of the bottom wall of the lower casing. Thus, no space is provided between the printed-circuit board and the bottom of the lower casing. In this case, the wires connecting the circuit patterns may be disposed along the edges of the printed-circuit board. Further, since the film substrate is comparatively thin, the thickness of the printed-circuit board is accordingly reduced.

In one form of the above feature, the keyboard further comprises an elastic sheet disposed on the printed-circuit board. The elastic sheet includes a multiplicity of cap portions corresponding to the multiple pairs of stationary electrodes. Each of the movable electrodes is secured to a lower surface of a top wall of the corresponding cap portion of the elastic sheet. The cap portions are elastically collapsible upon depression of the corresponding keys, whereby the corresponding movable electrodes are movable toward the corresponding pairs of stationary electrodes on the printed-circuit board.

In one advantageous arrangement of the above form of the invention, the printed-circuit board has an air vent formed through its thickness in each of a multiplicity of areas covered by the cap portions of the elastic sheet. The support plate has at least one groove formed in an upper surface thereof, in communication with the air vent in each area of the printed-circuit board enclosed by the corresponding cap portion of the elastic sheet, whereby an enclosure formed by each cap portion and the printed-circuit board is held in communication with the groove through the air vent.

The groove may be formed in communication with the enclosures formed by at least two of the multiplicity of cap portions and the corresponding areas of the printed-circuit board.

In the case where the keys are arranged in at least three parallel straight rows parallel to the longitudinal direction of the keyboard, the groove may be formed in the longitudinal direction, corresponding to each of the above-indicated at least three straight rows of keys. In this instance, the groove communicates with the enclosures formed by the cap portions corresponding to each straight row of the keys, and the corresponding areas of the printed-circuit board.

According to a yet further feature of the invention, the key-holder member includes a multiplicity of annular downward protrusions corresponding to the multiplicity of keys. Each downward protrusion extends from a lower surface of the key-holder member so as to surround the corresponding pair of stationary electrodes and the corresponding movable electrode.

According to another aspect of the present invention, there is provided a key switch which comprises: a film-like printed-circuit board having a circuit pattern on an upper surface thereof, the circuit pattern including a pair of stationary electrodes; a support plate on which the printed-circuit board rests; an elastic sheet resting on the printed-circuit board, and including an elastically collapsible cap portion disposed opposite to the pair of stationary electrodes, the cap portion cooperating with the printed-circuit board to define an enclosure in which the stationary electrodes are disposed; a movable electrode secured to a lower surface of a top wall of the cap portion of the elastic sheet; and an operator-controlled key operable to press the cap portion at the top wall thereof, thereby causing the cap portion to collapse, so as to move the movable electrode toward the corresponding pair of stationary electrodes. The printed-circuit board has an air vent formed therethrough in communication with the enclosure formed by the cap portion and the printed-circuit board. The support plate has a groove formed in communication with the air vent, so that air in the enclosure may flow into the groove through the air vent when the cap portion collapses upon depression of the key.

In the key switch of the invention constructed as described above, the air in the enclosure may easily escape through the air vent into the at least one groove formed in the support plate. Since the air vent is formed through the printed-circuit board, the thickness of the elastic sheet is not affected by the provision of the air vent. In other words, the provision of the air vent will not require an additional thickness of a keyboard which incorporates the key switch. Furthermore, since the air vent is formed in the area of the printed-circuit board which is not subject to a force of depression of the key, the air vent is not elastically deformed upon depression of the key.

According to one feature of the key switch of the present invention, the cap portion of the elastic sheet has a peripheral wall adjacent to an opening thereof at which the cap portion is closed by the printed-circuit board to form the enclosure. Upon collapse of the cap portion, the peripheral wall contacts the upper surface of the printed-circuit board, along a closed loop which is located inside an inner periphery of the cap portion which defines its opening. The air vent is positioned such that at least a part of the air vent is located inside the closed loop of the peripheral wall of the cap portion. This positioning of the air vent permits substantially the entire volume of air in the enclosure to escape through the air vent.

BRIEF DESCRIPTION OF THE DRAWINGS

The above and other objects, features and advantages of the present invention will be better understood by reading the following detailed description of a preferred embodiment of the invention, when considered in connection with the accompanying drawings, in which.

DETAILED DESCRIPTION OF THE PREFERRED EMBODIMENT

The present invention will be described in detail, by reference to the accompanying drawings showing one embodiment of the keyboard of the invention which incorporates many key switches.

Figure 1:
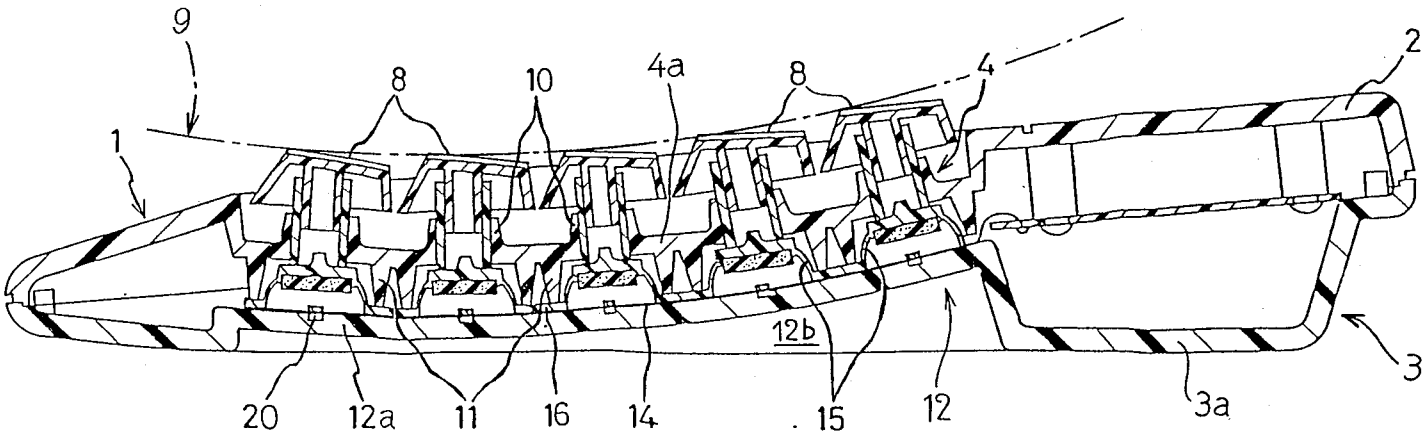
FIG. 1 is an elevational view in cross section of one embodiment of a keyboard of the invention.

Referring to the cross sectional view of FIG. 1, the keyboard has an upper casing 2 and a lower casing 3, which are both formed of a synthetic resin, and which engage each other to form a keyboard frame 1. The top wall of the upper casing 2 has a central rectangular aperture whose bottom is formed as a key-holder member 4 for movably supporting a multiplicity of keys 8, as described below. The key-holder member 4 has a base portion 4*a* which is downwardly curved in a plane parallel to the transverse direction of the keyboard (in the plane of FIG. 1), such that the base portion 4*a* descends in a direction from the rear toward the front of the keyboard, that is from the right-hand side end to the left-hand side end of FIG. 1.

Figure 2:
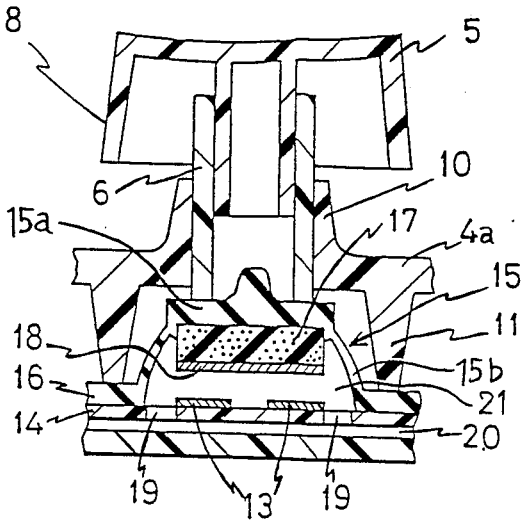
FIG. 2 is an elevational view of a key switch incorporated in the keyboard of FIG. 1.

Referring further to FIG. 2, each key 8 consists of a keystem 6 and a keytop 5 fixedly engaging the upper end of the keystem 6. The key-holder member 4 has a multiplicity of annular stem guides 10 integrally formed on the upper surface of the downwardly curved base portion 4*a*. These stem guides 10 are arranged in spaced-apart relation with each other, in five parallel straight rows which extend in the longitudinal direction of the keyboard. The keys 8 are supported by the key-holder member 4, such that the keystems 6 slidably extend through the respective stem guides 10. Thus, the keys 8 are also disposed in five parallel straight rows in the longitudinal direction of the keyboard. For preventing rotation of each key 8, the corresponding stem guide 10 has a recess (not shown), while the keystem 6 has a projection (not shown) which fits in the recess in the stem guide 10. The key-holder member 4 further has a multiplicity of integral annular downward protrusions 11 corresponding to the multiple keys 8. The protrusions 11 extend from the lower surface of the downwardly curved base portion 4*a* such that the protrusions 11 are concentric with the corresponding stem guides 10.

The lower casing 3 has an integral bottom wall 3*a* which includes an integrally formed upraised portion 12. This upraised portion faces the key-holder member 4 of the upper casing 2. The upraised portion 12 is formed so as to define a recess 12*b* which is open in a central part of the bottom wall 3*a*. The upraised portion 12 has a top wall 12*a* which serves as a support plate which will be described. The top wall or support plate 12*a* has substantially the same downward curvature as the downwardly curved base portion 4*a* of the key-holder member 4.

The support plate 12*a* supports a flexible film-like printed-circuit board 14 such that the lower surface of the board 14 is in direct contact with the upper surface of the support plate 12*a*. On the upper surface of the film substrate of the printed-circuit board 14, there are formed circuit patterns which include multiple pairs of stationary electrodes 13. On the upper surface of the printed-circuit board 14, there is disposed an elastic sheet 16 made of a silicone rubber. The elastic sheet 16 has a multiplicity of domed, elastically collapsible cap portions 15 which correspond to the multiple keys 8. The cap portions are located opposite to the pairs of stationary electrode 13. Each cap portion 15 cooperates with the corresponding area of the printed-circuit board 14 to define an enclosure 21 in which the corresponding pair of stationary electrodes 13 are accommodated.

Each cap portion 15 formed on the elastic sheet 16 has a top wall 15*a* to which the keystem 6 of the corresponding key 8 is fixed in abutting relation. As previously described, the thus supported keystem 6 slidably extends through the stem guide 10 of the key-holder member 4. Normally, the keytop 5 fixed to the keystem 6 is maintained in its non-operated position of FIG. 2, due to an elastic force of the cap portion 15. Since all of the keys 8 have the same size and shape, an operating surface 9 of the keys 8 which is generally defined by the top faces of the keytops 5 is downwardly curved following the curvature of the support plate 12*a*, i.e., the top wall of the upraised portion 12 of the lower casing 3.

The top wall 15*a* of each cap portion 15 has a sponge member 17 fixed to its inner surface, and a movable electrode 18 fixed to the sponge member 17 such that the movable electrode 18 is opposite to the corresponding pair of stationary electrodes 13, 13 formed on the upper surface of the printed-circuit board 14. In the non-operated position of FIG. 2, the movable electrode 18 is spaced away from the stationary electrodes 13. The key 8, stationary electrodes 13, movable electrode 18 and cap portion 15 constitute major parts of each key switch.

Figure 3:
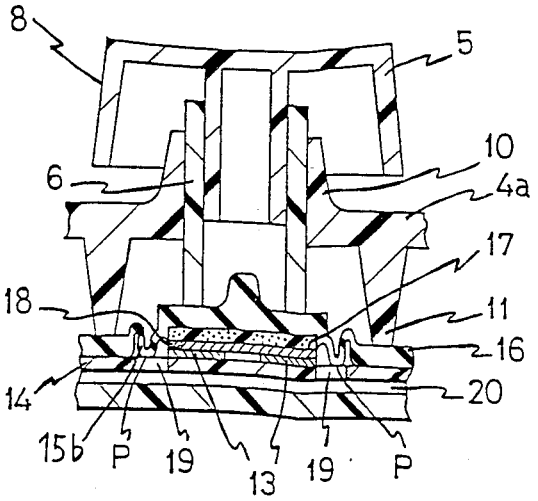
FIG. 3 is an elevational view of the key switch of FIG. 2, showing a state in which the key is depressed.

The flexible film-like printed-circuit board 14 has two air vents 19, 19 formed through the thickness in each of the areas covered by the cap portions 15. More specifically, the two air vents 19 are formed adjacent to the respective two stationary electrodes 13 in each enclosure 21, and are positioned radially outside the stationary electrodes 13 with respect to the circular opening of the domed cap portion 15. The air vents 19 for each key 8 communicate with the corresponding enclosure 21, and the air vents 19 for each row of the keys 8 lie on a straight line in the longitudinal direction of the keyboard. As described later, the air vents 19 are positioned so that substantially the entire volume of air in the enclosure 21 may escape through these vents. The support plate 12*a* has five parallel grooves 20 formed in its upper surface, extending parallel to the rows of the keys 8, such that each groove 20 communicates with the air vents 19, 19 corresponding to the keys 8 in each row. In this arrangement, the air in the enclosures 21 may flow into the appropriate grooves 20 through the air vents 19, when the cap portions 15 elastically collapse upon depression of the keys 8 to the operated position of FIG. 3. As a result of this collapse, a peripheral wall 15*b* of the cap portion 15 adjacent to the open end of the cap 15 contacts the upper surface of the printed-circuit board 14, along a closed loop which is located inside the periphery of the open end of the cap portion 15, as indicated at P in FIG. 3. For better air breathing, the location of the air vents 19, 19 is determined so that at least a part of each air vent 19 is located inside the above-indicated closed loop that defines the line of contact between the peripheral wall 15*a* of the cap portion 15 and the upper surface of the printed-circuit board 14.

The operation of the key switch will be described. When the key 8 is depressed at its keytop 5 against an elastic force of the cap portion 15 of the elastic sheet 16, the key 8 is moved downward with the keystem 6 being slidably guided by the stem guide 10 of the key-holder member 4. As the keystem 6 is moved down and the cap portion 15 elastically collapses, the movable electrode 18 fixed to the top wall 15*a* of the cap portion 15 via the sponge member 17 is moved down toward the pair of stationary electrodes 13 on the printed-circuit board 14. Eventually, the movable electrode 18 contacts the two spaced-apart stationary electrodes 13. Thus, the stationary electrodes 13 are capacitively coupled to each other, whereby a signal is transmitted from one of the stationary electrodes 13 to the other as a key signal. As the cap portion 15 collapses, the air within the enclosure 21 escapes into the appropriate groove 20 via the air vents 19. Consequently, the key 8 may be easily moved to its operated position of FIG. 3. Further, since the movable electrode 18 is fixed to the cap portion 15 via the sponge member 17 in this embodiment, the sponge member 17 elastically yields if a depression force continuously acts on the keytop 5 after the movable electrode 18 has contacted the stationary electrodes 13 with the cap portion 15 considerably deformed. This elastic yielding of the sponge member 17 assures complete contact of the movable electrode 18 with the stationary electrodes 13, and reliable switching operation of the key switch. When a depression force is released from the keytop 5, the key 8 is moved toward its non-operated position, by the resilient forces of the sponge member 17 and the cap portion 15, as the air is sucked into the enclosure 21 through the groove 20 and the air vents 19. As a result, the movable electrode 18 is separated from the stationary electrodes 13, whereby the key switch is opened.

It is to be understood that the invention is not limited to the details of the illustrated embodiment, but may be embodied with various changes and modifications, for example, in connection with the configuration and location of the air vents 19 and grooves 20.

What is claimed is:

1. A keyboard comprising:

an upper casing and a lower casing, which engage each other to form a keyboard frame;

a printed-circuit board disposed within said frame, and having multiple stationary electrodes;

a support plate fixed to said lower casing, and disposed below said printed-circuit board for supporting the printed-circuit board;

a multiplicity of movable electrodes corresponding to said multiple stationary electrodes;

electrode support means for supporting each of said movable electrodes movably toward and away from the corresponding stationary electrodes, such that said movable electrodes are normally held away from said corresponding stationary electrodes;

a multiplicity of operator-controlled keys corresponding to said multiplicity of movable electrodes, for actuating the electrode support means and thereby moving the corresponding movable electrodes toward the corresponding stationary electrodes; and a key-holder member fixed to said upper casing, for supporting said multiplicity of keys such that said keys are slidably movable in an axial direction thereof in actuating relationship with said electrode support means;

wherein said lower casing includes an integral bottom wall having an integrally formed upraised portion which defines a recess open in a central part of the bottom wall, said upraised portion having a top wall which forms a bottom of said recess, said support plate being constituted by said top wall of said upraised portion.

2. A keyboard according to claim 1, wherein said top wall of said upraised portion of the lower casing has a slight downward curvature in a plane parallel to a transverse direction of the keyboard and perpendicular to said upraised portion.

3. A keyboard according to claim 1, wherein said top wall of said upraised portion of the lower casing is inclined in a plane parallel to a transverse direction of the keyboard such that a height of an upper surface of said top wall from said bottom wall increases in a direction from a front toward a rear of the keyboard.

4. A keyboard according to claim 1, wherein said lower casing having said upraised portion is formed of a synthetic resin.

5. A keyboard according to claim 1, wherein said upper casing and said key-holder member are formed of a synthetic resin as a one-piece structure.

6. A keyboard according to claim 1, wherein said multiplicity of operator-controlled keys have the same size and shape, and said support plate is downwardly curved in a plane perpendicular to a longitudinal direction of the keyboard, said key-holder member including a downwardly curved base portion which is substantially parallel to said support plate, said key-holder member supporting said keys in at least three parallel straight rows which extend in said longitudinal direction, such that a surface generally defined by top faces of said keys is downwardly curved in said plane.

7. A keyboard according to claim 1, wherein said printed-circuit board comprises a film substrate, and circuit patterns which include said stationary electrodes and which are disposed on an upper surface of said film substrate, said printed-circuit board resting on said support plate such that a lower surface of said film substrate is in close contact with an upper surface of said support plate.

8. A keyboard according to claim 7, wherein said electrode support means comprises an elastic sheet disposed on said printed-circuit board, said elastic sheet including a multiplicity of cap portions corresponding to said multiple stationary electrodes, each of said movable electrodes being secured to a lower surface of a top wall of the corresponding cap portion of the elastic sheet, said cap portions being collapsible upon depression of the corresponding keys, whereby the corresponding movable electrodes are movable toward the corresponding stationary electrodes on said printed-circuit board.

9. A keyboard according to claim 8, wherein said printed-circuit board has an air vent formed through its thickness in each of a multiplicity of areas covered by said cap portions of said elastic sheet, said support plate having a groove formed in an upper surface thereof, in communication with said air vent in said each area of the printed-circuit board, whereby an enclosure formed by each of said cap portions and the corresponding area of said printed-circuit board is held in communication with said groove through said air vent.

10. A keyboard according to claim 9, wherein said groove communicates with the enclosures formed by at least two of said multiplicity of cap portions and the corresponding areas of the printed-circuit board.

11. A keyboard according to claim 10, wherein said multiplicity of keys are arranged in at least three parallel straight rows which extend in the longitudinal direction of the keyboard, said groove being formed in said longitudinal direction corresponding to each of said at least three straight rows of said keys, said groove communicating with the enclosures formed by the cap portions corresponding to said each straight row of the keys and the corresponding areas of the printed-circuit board.

12. A keyboard according to claim 1, wherein said key-holder member includes a multiplicity of annular downward protrusions corresponding to said multiplicity of keys, each of said downward protrusions extending from a lower surface of said key-holder member so as to surround the corresponding movable and stationary electrodes.

13. A key switch, comprising:

a film-like printed-circuit board having a circuit pattern on an upper surface thereof, said circuit pattern including at least one stationary electrode;

a support plate on which said printed-circuit board rests;

an elastic sheet resting on said printed-circuit board, and including an elastically collapsible cap portion disposed opposite to said at least one stationary electrode, said cap portion cooperating with said printed-circuit board to define an enclosure in which said at least one stationary electrode is disposed;

a movable electrode secured to a lower surface of a top wall of said cap portion of said elastic sheet; and an operator-controlled key operable to press said cap portion at said top wall thereof, thereby causing said cap portion to collapse, so as to move said movable electrode toward said at least one stationary electrode;

wherein said printed-circuit board has an air vent formed therethrough in communication with said enclosure;

wherein said support plate has a groove formed in communication with said air vent, so that air in said enclosure may flow into said groove through said air vent when said cap portion collapses upon depression of said key; and wherein said cap portion has a peripheral wall adjacent to an opening thereof at which said cap portion is closed by said printed-circuit board to form said enclosure, said peripheral wall contacting, upon collapse of said cap portion, the upper surface of said printed-circuit board along a closed loop which is located inside an inner periphery of said cap portion which defines said opening thereof, said air vent being positioned such that at least a part of the air vent is located inside said closed loop of said peripheral wall.

14. A key switch assembly comprising:

a film-like printed-circuit board having a circuit pattern on an upper surface thereof, said circuit pattern including a plurality of stationary electrodes;

a support plate on which said printed-circuit board rests;

an elastic sheet resting on said printed-circuit board, and including a plurality of elastically collapsible cap portions disposed opposite to said plurality of stationary electrodes, said cap portions cooperating with said printed-circuit board to define a plurality of enclosures in which said plurality of stationary electrodes are disposed;

a plurality of movable electrodes respectively disposed on lower surfaces of top walls of said cap portions of said elastic sheet; and a plurality of operator-controlled keys operable to press said cap portions at said top walls thereof, thereby causing said cap portions to collapse so as to move said movable electrodes toward the corresponding stationary electrodes;

wherein said printed-circuit board has a plurality of air vents formed therethrough, such that each of said plurality of enclosures communicates with at least one of said air vents; and wherein said support plate has at least one groove formed therein, each of said at least one groove communicating with at least two of said plurality of enclosures through the air vents communicating with said at least two enclosures.

15. A key switch assembly according to claim 14, wherein said plurality of operator-controlled keys are arranged in at least two parallel straight rows which extend in a longitudinal direction of the key switch assembly, said each groove being formed in said longitudinal direction corresponding to each of said at least two straight rows of said keys, said groove communicating with the enclosures which are defined by the cap portions corresponding to said each straight row of the keys and corresponding areas of said printed-circuit board.

* * * * *